United States Patent [19]

Jackson

[11] Patent Number: 4,824,417

[45] Date of Patent: Apr. 25, 1989

[54] DYNAMIC WRESTLING FIGURES

[75] Inventor: Paul C. Jackson, East Elmhurst, N.Y.

[73] Assignee: Redemption Church of Christ, Troy, N.Y.

[21] Appl. No.: 80,812

[22] Filed: Aug. 3, 1987

[51] Int. Cl.[4] ..... A63H 13/06

[52] U.S. Cl. ..... 446/335; 446/361; 40/411

[58] Field of Search ..... 40/415, 414, 411; 446/334, 335, 357, 358, 364, 361, 365, 322, 323, 324, 352, 359, 362

[56] References Cited

U.S. PATENT DOCUMENTS

| | | | |
|---|---|---|---|
| 276,097 | 4/1883 | Thomson | 446/334 X |
| 865,564 | 9/1907 | Brown | 446/334 |
| 1,167,958 | 1/1916 | Watkins | 446/334 |
| 1,753,032 | 4/1930 | Stein et al. | 446/361 |
| 2,114,657 | 4/1938 | Mangold | 446/357 |
| 3,700,384 | 10/1972 | Gardel et al. | 446/365 X |
| 4,074,459 | 2/1978 | Lopez | 446/361 |

FOREIGN PATENT DOCUMENTS

| | | | |
|---|---|---|---|
| 1293137 | 12/1962 | France | 446/335 |
| 507724 | 1/1955 | Italy | 446/358 |

*Primary Examiner*—Mickey Yu

*Attorney, Agent, or Firm*—Schmeiser, Morelle & Watts

[57] ABSTRACT

An amusement device of two moveably jointed, co-joined, articulated figures. The head of the first figure is caused to twist irregularly about its vertical axis and simultaneously impart a spasmodic momentum to the second figure. The figures are animated by the cooperation of the irregular twisting action operating through the first body and into the second through their joining. Motivation is suggested, as well as disclosed herein, for imparting an irregular torquing moment to the first of the figures.

7 Claims, 3 Drawing Sheets

DYNAMIC WRESTLING FIGURES

FIELD OF THE INVENTION

This invention relates to an amusement device, more particularly to a toy that simulates the various postures effected by a pair of wrestlers. Although it may be conceivably used as an interactive toy, the preferred embodiment conceives of single operator usage that is meant to amuse use rather than instill a combative or competitive spirit in the participants.

BACKGROUND AND SUMMARY OF THE INVENTION

Many games, both interactive and sole participant, have been developed through the years and which have the primary purpose of amusement only, that is, it was the intent of the inventors to delight the player or participant rather than instill in two or more players a competitive or combative spirit. An almost negligible portion of these games, if of the purely amusement type, were composed of two or more characters, dolls or game devices. It seemed to the inventor that if one were to amuse oneself by observing a game that related to a combative sport (boxing, wrestling, karate, etc.), he would have to view television, cinema or attend such a function, in person.

I devised the present invention so that a child of tender years could be amused by a two-character game, specifically wrestling or any game which included body grips and unusual physical contortions or postures, without being compelled to face violent situations or a rival in order to enjoy the game. Also after watching younger children enjoy cartoons and television shows dealing with today's superheros, I felt there was a compelling need to provide such an amusement device that would allow the child to simply enjoy the game as an observer, without being inundated by the superfluous media that today attends such events.

One of the first attempts to provide amusement of the aforementioned type, was that disclosed by Watkins in his AMUSEMENT DEVICE, U.S. Pat. No. 1,167,958. The Watkins invention embodied a pair of jointed puppets that employed interactive manipulative means to effect a boxing activity. The doll employed in the Watkins device used pivoting at the hip joints and at the shoulder joints.

Unfortunately, this pivotable jointing allowed only a single degree of freedom (rotational) for the members so joined. The interactive play of the rival players comprised a jiggling or up-and-down motion which was imparted to the dolls by a string-pulley arrangement. A single connection between the dolls of this invention, at the boxers' abdomens, served to maintain the dolls at the same proximity. Although this mechanism served Watkins well, it would not suffice in my invention since the posture of wrestlers is one of almost constant interconnectivity which could not be served by either the singular hip and arm rotational motions, the held-apart relationship of the dolls or the jiggling action.

In 1938, Mangold disclosed, in U.S. Pat. No. 2,114,657 an ADVERTISING AND AMUSEMENT DEVICE that required only single participant (or drive means) activity and effected a pair of boxers engaged in the sport while suspended over, but not touching, a horizontal surface. Intermittent or momentary fixed contact was made between the fighters by the placement of small spikes on their hands. When contact was made by the fist of one fighter with the body of the other, the spikes would momentarily penetrate the body of the struck fighter. Thus, as with the Watkins invention, Mangold's could at best effect only an intermittent coupling or clinching, which is not satisfactory for a wrestling-type amusement device. Further, even though Mangold employed connections to the heads of his figures, the motion imparted to them was a jiggling motion rather than a twisting and turning motion which is more common in wrestling and in the prolonged body contacting sports.

One invention having only a single figure was disclosed by Gardel, in U.S. Pat. No. 3,700,384, in 1972. The singular doll figure was attached to a motive mechanism, at its head. It was the purpose of the motive mechanism to impart a regular torquing motion to the figure which possessed interconnected moveable arms and thighs. Because this doll was to effect the motions of a ballerina, the arm and leg motions were of necessity synchronized. This very clever amusement device well suited the objectives of the inventor; but those objectives led to the creation of a device which was inappropriate for effecting the motions of two figures, notably wrestlers. In order to provide a suitable wrestling simulation amusement device, it was necessary to overcome the limitations of the prior art by providing a motor means which torqued rather than jiggled the characters, dolls or figures. Further, it was found necessary to provide connections essentially at the head of one of the figures so that a twisting motion rather than a jiggling motion could be imparted to it. Finally, a means was devised for imparting an irregular twisting motion as well as a stylized interconnectivity or coupling between the figures to assure a form of continued gripping and clinching contact.

In carrying out the invention I have employed a pair of human-like figures of the same shape and dimension, fashioned out of a relatively light-weight material such as balsa wood or polystyrene. The heads of the figures are attached by slender flexible shafts, preferably wire, to the clavicle portion of the body. The arms of both figures are formed circularly, the fore and upper arms being rigid and fixedly joined together. The hands of each figure are joined and actually comprise either a singular loop of wire or an interlinked pair of clevises; thus, each figure's forearms are joined by a "hand". The upper arms pivot at the shoulder and thus, in their rigid circular posture, can move with only a single degree of freedom (rotational). In my preferred embodiment, the hand loop of the second figure is pivotally fixed about the neck shaft of the first figure. This is done in order that the motion or torque which will be applied, to the first figure only, will serve to carry the second figure along with the first. Continuing with the construction of the figures, rigid thighs are fixedly joined, at predetermined angles, to rigid lower legs. The thighs are joined to the hip positions of the figures by links that allow essentially two degrees of freedom movement. The remaining portion of the body comprises fixedly joined foot portions that may be joined to the lower ends of the lower legs in varying angular relationship.

The figures are suspended above a frictional surface that will have the effect of retarding or restricting the sliding or moving motion of the figures as they sweep over it. A single wire is connected to a clevis located on the top of the head of the first figure and it is through this wire that an intermittent torque is applied to the assembled apparatus. The means which I have employed for applying intermittent torque to my invention is a very thin, flexible wire which has the ability to store a rotational force (torque) as spring tension. Those familiar with the art will recognize that several means of imparting intermittent torque are possible, including an intermittently operated motor, a flexible spring such as employed by the inventor, a rotating shaft which has been linked to the head of the first figure by a coiled spring, rubber bands, or other suitable tension-storing device or the application of the torque through a slip-clutch transmission.

To operate the invention and effect the various wrestling postures, it is only necessary to impart a torquing moment to the top of the head of the first figure. The frictional surface has a tendency to constrain the first figure (and the second figure which is connected to the first) in its rest position. The torquing force builds and is aggregated by the tension storing mechanism until enough force is accumulated to overcome the frictional constraint on the figures, as well as rest inertia, and the first figure abruptly breaks free of the restraining surface. The second figure, teathered to the first by its hand-neck connection, is literally dragged and twisted along with the first figure. The momentum of the twisting figures rapidly releases the tension in the tension storage means and imparts, by inertia, a countertorque back along to the motive means. At this point, the figures come to rest in an entirely different posture. The continual or intermittent application of the torquing force, combined with the near-instantaneous break away of the figures from the constraining medium, allows the observer to witness myriad postural relationships between the figures that very closely emulate a wrestling pair.

Other objects of the invention and other amusement applications as may be hereinafter devised should become apparent from practice with the novel elements of the preferred embodiment. Such objects and varying applications are meant to be limited therefore only by the appended claims.

DETAILED DESCRIPTION OF THE PREFERRED EMBODIMENT

Figure 1:
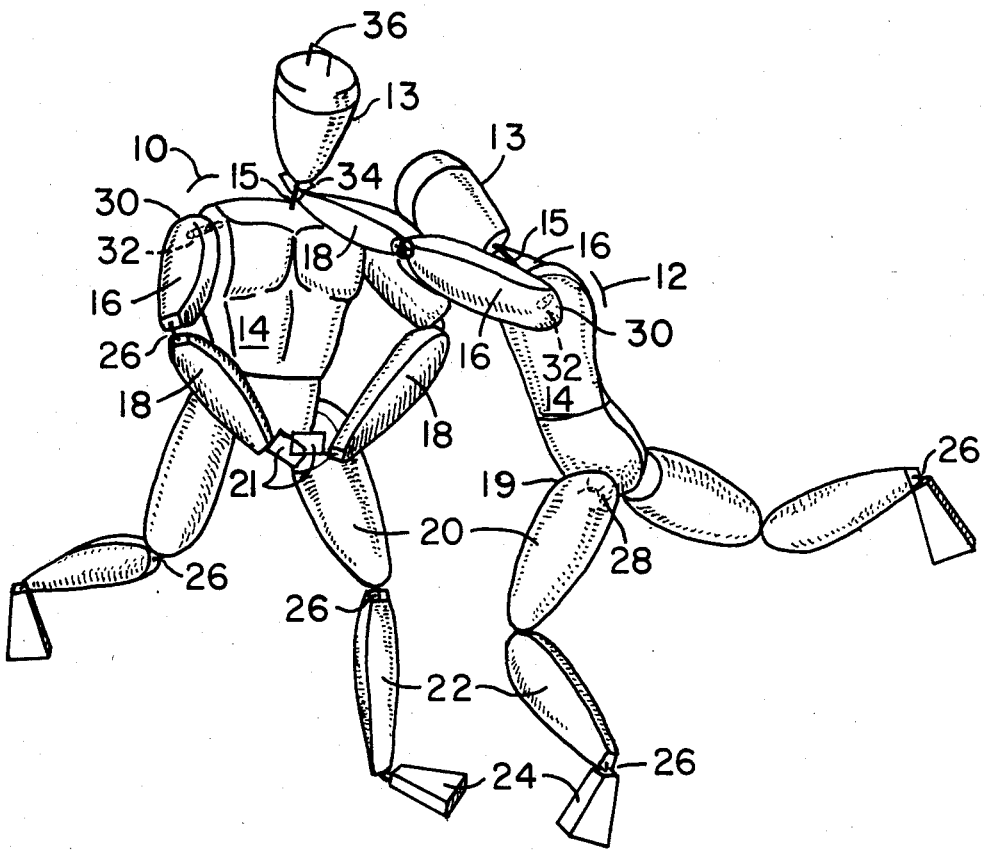
FIG. 1 is an isometric illustration of the two figures of the invention.

Reference now being had to the drawings, specifically FIG. 1, there is depicted a first FIG. 10 and a second FIG. 12. This isometric illustration portrays the two human-like figures of the preferred embodiment with the limbs of the bodies poised so as to reflect a singular possible posture of the two figures. Each figure comprises a head 13 attached to a torso 14 by a single straight wire 15 that further comprises the neck shaft of each figure. The upper arms 16 and the thighs 20 are pivotally affixed to the torso and comprise he only moving parts of the discrete figures; specifically, motion or movement is effected at shoulder-upper arm joint 30 and hip-thigh joint 19. Forearms 18 are connected to upper arms 16 by a bendable wire 26. With the exception of joints 30, 19, all other joints between the various limbs, torso and head are comprised of such bendable wire 26. At the ends of the forearms are the figures' hands comprised of interlinked clevises or loops 21, in the case of the first FIG. 10, and a single loop 34, in the case of the second FIG. 12. The observer should note that this form of linkage gives rise to a circular arm formation for both figures that, because of pivotal pin 32, will allow the arms to move only upward and downward, in relation to the torso; that is, the plane comprising the arm circle can pivot upward and downward with a single degree of freedom.

The thighs are joined to the torso hips at joint 19 in a slightly different fashion than the arms. Interlinked cleavises 28, or wire loops, are used to lend a two-degree of freedom movement to the leg members. As with the arms, the remaining portion of the legs (the lower 22) and foot parts 24 are joined in the same fashion, by attaching the feet to the lower legs, and they to the thighs 20 by means of bendable wires 26. The use of bendable wires 26 allows the bending of the lower leg portions into different angular relationships with respect to the thighs 20.

Two distinct differences ar noticed in this illustration that avoid congruence between the figures. First, the "hands" of the first FIG. 10 comprise interlinked wire loops or clevises 21. These loops are herein depicted having angular geometries, more precisely they are squares. If, instead, a clevis is inserted at the end of each forearm 18, interlinked with its counter part to form the hand 21 herein depicted, they should be shaped to embody right angles. Although a circular loop or interlinked loops have been used with some degree of success, as well as a bendable wire 26, the inventor has observed the best operation of his invention when all elements are constructed as herein portrayed.

The second difference is the placement of the single loop 34 which comprises the hands of second FIG. 12, about the neck shaft 15 of the first FIG. 10. When an irregular torquing moment is applied about the head 13 of the first FIG. 10, only it (the first figure) has a tendency to rotate. With the first spasm however, the arms of the first figure rise and engage the outstretched arms of the second figure in a somewhat lifting motion. As the first figure breaks away from its original (inert) position, the second figure is dragged by the connection 34/15 and urged upward because of the rising twisting motion of the first figure's arms 16/18. It must be remembered that only the first figure is actually a motivated figure; in that, the torquing moment is being applied at the first figure's head clevis 36. It is the sudden spasmodic movement of the first figure which thrusts the second figure, constrained at point 34/15 into a slightly upward and tangential direction. Simultaneously, the torso 14 of the second figure, taking the momentum delivered through its arms 16/18, attempts to rise off its legs, allowing them to rotate on joints 28 with essentially two degrees of freedom. Thus, when the figures come to rest again, the original posture has been radically perturbed and a new one has been assumed.

Figure 2:
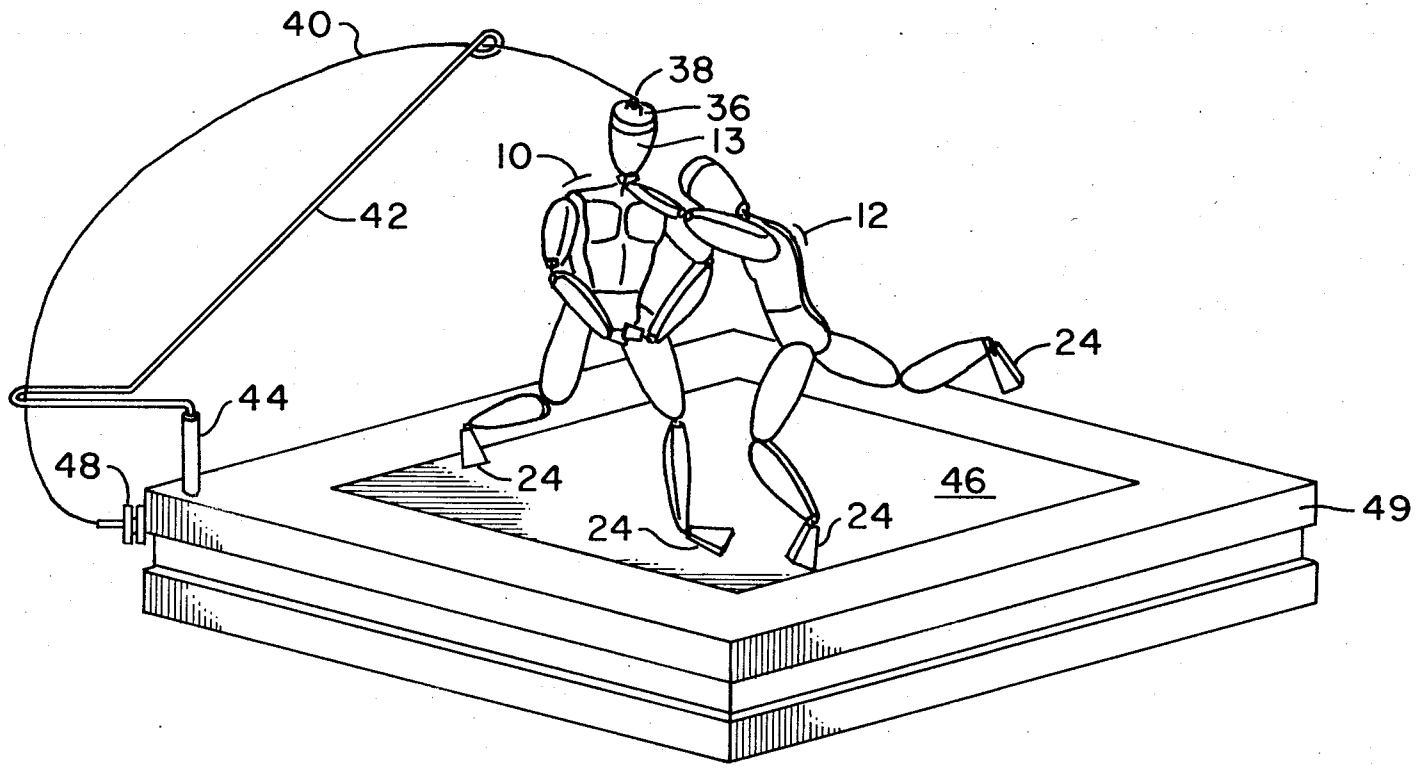
FIG. 2 is an isometric illustration of the two figures suspended over a frictional surface.

FIG. 2 is an isometric illustration of the assembled amusement device of the instant invention. The figures are suspended by flexible wire 40 connected by wire loop 38 to the first figure's head clevis 36. Brace 42 ensures that wire 40 suspends the figures at a point where they just make contact between foot members 24 and frictional surface 46. Frictional surface 46 is in actuality the top of box 49 and also serves as a receiver for support mounting 44. Tube 48 represents the conduit for the output shaft of a rotary motive device. The coupling of output shaft 50 through flexible wire 40 to the head 13 of the first FIG. 10 insures direct coupling of the torquing moment to the first figure.

As in the aforementioned operating description, when a torquing moment is applied to head 13, the twisting motion of the first FIG. 10 (which is very abrupt, as the figures' feet 24 break away from frictional surface 46), causes both figures to take on a sudden momentum that serves to reposition the limbs and to effect a totally different combative posture. Even though the "hands" of the second figure never leave the neck of the first figure, nor do the arms of the first figure ever grasp or take hold of the body of the second figure, the myriad physical contortions that the figures appear to emulate, leave the viewer with a distinct impression that the figures are engaged in wrestling.

Figure 3:
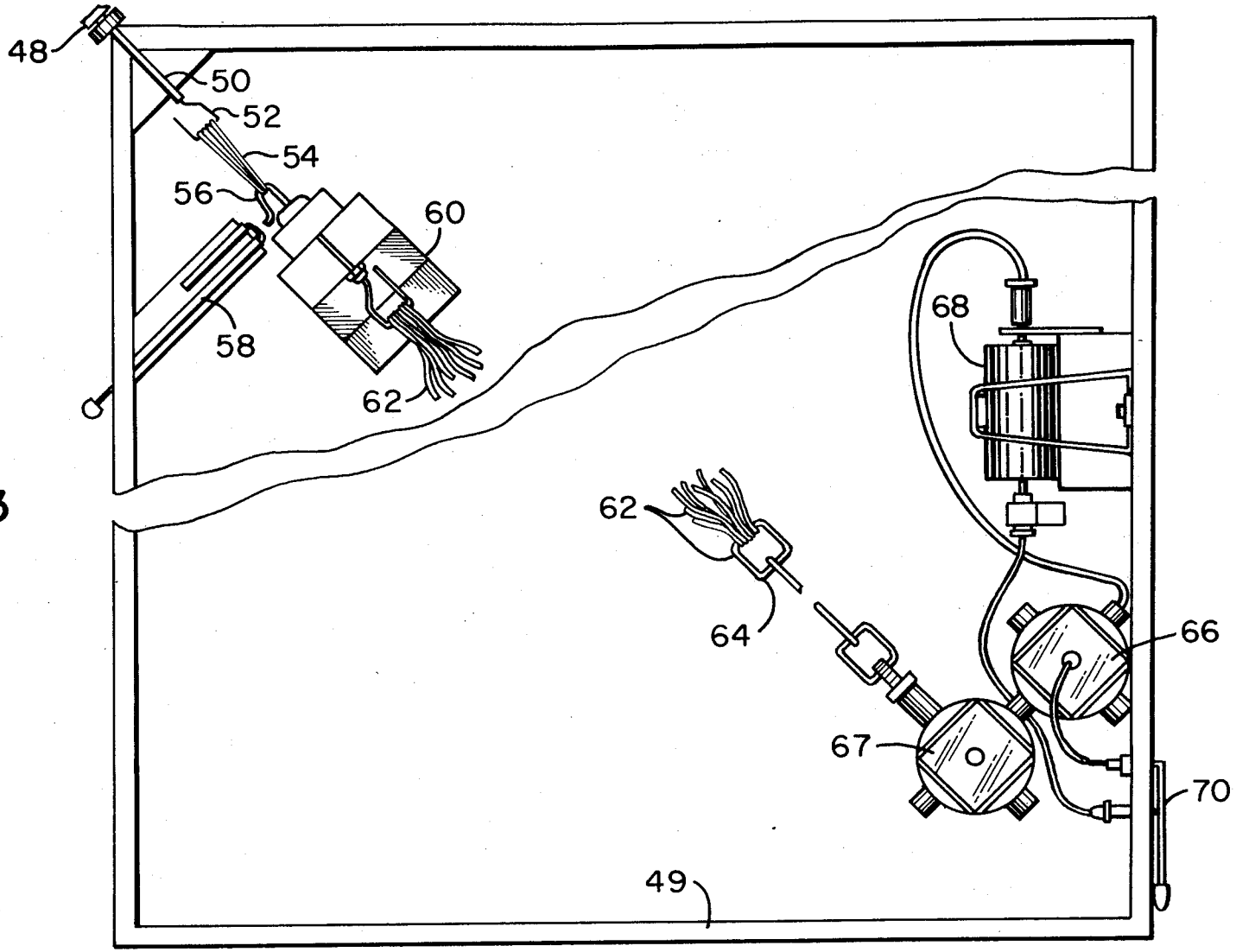
FIG. 3 is a top view schematic of the motive means and torque storage means.

Box 49 contains the motive mechanism for the apparatus and is depicted in the schematic of FIG. 3. The torquing moment output shaft 50 is observed in the upper left hand corner and penetrates through the corner of the box by a tube 48, terminating in hook 52. The linkage between hook 52 and coupling mechanism 64, which is attached to the output shaft of transmission 67, is an embodiment selected by the inventor which would allow him to transmit the torque of electric motors 66 through transmission 67 to output connecting shaft 50 in a cost-effective manner while still acquiring a torque storage mechanism to effect the intermittent application of torque to the first figure. Rubber bands 54/62 are used singularly or pluralistically in generally parallel array, to convey the torquing moment applied to coupling 64 to hook 52. Push-pull tab 58 is used to intercept the end of hook 56 so as to abruptly stop all rotary motion that is applied to shaft 50. Inertial cylinder 60 is employed by the inventor so as to maintain the system's rotational inertia, much in the manner of an automotive fly wheel, after it has been set in motion. The entire apparatus presented between coupling 64 and shaft 50 is extremely useful for imparting the intermittent torquing moment; but, it is not considered an essential part of the invention. Likewise, the use of electric motor 66 gives rise to a need for battery or power source 68 means and switch 70 means in order to effect its operation. However, those of ordinary skill will recognize that shaft 50 may be readily driven by a rotary hand crank and a single rubber band 62 with or without an interial mass 60. In actual operation, the preferred embodiment operates as follows: the interrupt shaft 58 is inserted until it engages hook 56, assuring that no motion will commence until it is withdrawn. Switch 70 is thrown energizing motor 66 by battery 68 and motive power is applied through transmission 67 to coupling 64. The rotational moment representing output from the transmission 67 is stored in the rubber bands 62. When desired, the operator of the device withdraws interrupter 58 from hook 56 and rotary moment is immediately applied to interial mass 60, which in turn drives shaft 50, rapidly twisting flexible wire 40. The acute onset of rotary moment savagely twists the head of the first figure snapping the figure free of the frictional restraint 46, in what appears an attempt to "throw" the second figure. Inertial mass 60 will over shoot the nominal unwound position of bands 62 and, if the player desires interrupter 58 may be at that time inserted and the figures abruptly stopped. Whether interrupter 58 is used is irrelevant as the figures will always assume a new and uniquely contorted posture.

Other combative sport types of games may be readily devised admitting to the principles herein disclosed for this wrestling amusement device. While the instant invention derives its unique reposturing characteristics through the use of an irregularly applied force and an asymmetrical coupling between its figures, it is recognized tat several other variations of this particular theme may very well be attempted. Uses and application of the invention are therefore meant to be practiced within the scope of the appended claims.

What is claimed:

1. An amusement device comprising:

a first movably jointed game figure set on a frictionally constraining surface and adapted for sliding movement thereover, said first figure adapted to alone receive irregular torquing moment at a head portion;

means for applying irregular torquing moment only to the head of said first figure; and a second movably jointed game figure pivotally attached to said first figure, whereby application of said irregular torquing moment to the first figure causes it to spasmodically twist over said surface into a contorted posture and carry the second figure into a similarly contorted posture thereby effecting a postural relationship between said figures resembling a dynamic physically combative pair.

2. The invention of claim 1 wherein both figures comprise human-shaped dolls that are moveably jointed only at the shoulder/arm and thigh/hip joints, said first figure's hands comprised of interlocking means, and said second figure's hands comprised of a single loop that interconnects the figure's for arms, whereby each of said figure's arms form a circle that moves with a single degree of freedom relative to the figure's torso and each of said figure's legs move with two degrees of freedom relative to the figure's torso.

3. The invention of claim 2 wherein said means for applying irregular torquing comprises:

motive means adapted to output torque;

accumulator means for storing the torque output by said motive means;

a flexible wire for receiving and transferring the output torque from said accumulator means; and coupling means for attaching the wire to said first figure so that the torque will be transferred through said wire to the first figure in an irregular manner as the restraint on said first figure by the frictional surface is intermittently overcome by the accumulated tension in the wire.

4. The invention of claim 3 wherein said coupling means comprises a loop in the wire, said loop attached to a clevis in the head of the first figure.

5. The invention of claim 4 wherein said motive means is a motor.

6. The invention of claim 4 wherein said motive means is a hand crank.

7. The invention of claim 2 wherein the hands loop of said second figure is attached about a singular neck shaft of said first figure, whereby the second figure might fixedly pivot about said shaft and be carried into spasmodic motion by the abrupt movements of the first figure.

* * * * *